US007322362B2

(12) United States Patent
Tiram

(10) Patent No.: US 7,322,362 B2
(45) Date of Patent: Jan. 29, 2008

(54) NAIL TREATING TOOL AND METHOD OF TREATING NAILS

(76) Inventor: Aaron Tiram, 100 E. Huron, Chicago, IL (US) 60611

( * ) Notice: Subject to any disclaimer, the term of this patent is extended or adjusted under 35 U.S.C. 154(b) by 0 days.

(21) Appl. No.: 11/021,737

(22) Filed: Dec. 23, 2004

(65) Prior Publication Data

US 2006/0137704 A1 Jun. 29, 2006

(51) Int. Cl.
*A45D 29/18* (2006.01)

(52) U.S. Cl. ..... 132/74.5; 132/75.6

(58) Field of Classification Search ..... 132/75.6, 132/76.4, 76.5; 451/523, 524, 525, 557; 222/192, 457.5, 480; 401/265, 266, 41; D28/56, D28/57, 59

See application file for complete search history.

(56) References Cited

U.S. PATENT DOCUMENTS

| | | | | | |
|---|---|---|---|---|---|
| 2,996,743 | A | * | 8/1961 | Noble | 15/98 |
| 3,432,975 | A | * | 3/1969 | Parker | 451/524 |
| 4,184,499 | A | * | 1/1980 | Seidler | 132/75.6 |
| 4,211,246 | A | * | 7/1980 | Hokama | 132/76.4 |
| D262,148 | S | * | 12/1981 | Sussman | D28/59 |
| D281,729 | S | * | 12/1985 | Mast | D28/59 |
| 5,287,863 | A | | 2/1994 | La Joie et al. | |
| 5,337,523 | A | * | 8/1994 | Walsh | 451/502 |
| D368,401 | S | * | 4/1996 | Dixon | D6/522 |
| 5,578,098 | A | * | 11/1996 | Gagliardi et al. | 51/295 |
| 5,658,184 | A | * | 8/1997 | Hoopman et al. | 451/28 |
| 5,727,750 | A | * | 3/1998 | Kelly | 242/596.3 |
| D406,394 | S | * | 3/1999 | Mulaisho | D28/57 |
| 6,050,270 | A | | 4/2000 | Tyshenko, Jr. | |
| 6,142,156 | A | * | 11/2000 | Brunderman | 132/76.4 |
| 6,145,151 | A | * | 11/2000 | Herron et al. | 15/143.1 |
| 6,352,180 | B1 | * | 3/2002 | Reyhons | 222/142.1 |
| D468,864 | S | * | 1/2003 | Rieser | D28/59 |
| 6,733,595 | B1 | * | 5/2004 | Grillo | 134/6 |

FOREIGN PATENT DOCUMENTS

DE 20200577 U * 4/2002

OTHER PUBLICATIONS

German Translation of Patent No. DE 202 00 577□□Udo Rieser, Nail File, May 8, 2002.*

* cited by examiner

*Primary Examiner*—Todd E. Manahan
*Assistant Examiner*—Rachel A. Running
(74) *Attorney, Agent, or Firm*—Wood, Phillips, Katz, Clark & Mortimer

(57) ABSTRACT

A nail treating tool having a graspable handle, a first treating surface, and a second treating surface. The first and second treating surfaces are interchangeably placeable in an operative position relative to the graspable handle such that the graspable handle can be grasped by a user and manipulated to bear one of the first and second treating surfaces that is in the operative position against a nail to effect treatment thereof.

15 Claims, 4 Drawing Sheets

NAIL TREATING TOOL AND METHOD OF TREATING NAILS

BACKGROUND OF THE INVENTION

1. Field of the Invention

This invention relates to toenails and fingernails and, more particularly, to a tool for, and method of, treating the same.

2. Background Art

Myriad tools have been designed to treat real and artificial nails, commonly preparatory to applying coating. It is also known to treat the nails, as by buffing, so that the nails have a neat and finished appearance without any additional foreign substance applied thereto.

As one example, emery boards have existed for decades. Emery boards have been conventionally designed with a flexible, generally flat, elongate shape. Opposite sides of the emery board may have abrasive material thereon with the same or different properties. Emery boards are commonly used to make gross treatments to the nails, as to remove irregularities and provide a generally smooth overall surface.

It is known to buff nails using either power tools, such as those having a rotary head, or manually operable tools, which may be in the form of pads. The manual tools come in a wide range of forms. Some have graspable handles, while other are generally in the same shape as conventional emery boards.

Buffing tools are currently available with many different buffing properties. It is known to use different tools to sequentially buff nails with these different tools to progressively achieve a desired look. This may necessitate having on hand potentially a large number of different tools. Manicurists that use these types of tools must store, and have accessible, all of these various tools that may be required to perform a procedure.

As noted above, these tools often have some sort of graspable handle associated with them. Each such tool thus has a self-contained form. If tools with all the desired characteristics are to be kept on hand, a substantial amount of storage space may be required, as at shops where manicuring is performed and in homes in which these types of tools are used.

It may also be difficult to keep these tools on hand in a manner to conveniently coordinate their use.

The industry continues to seek out tools and techniques which facilitate a wide range of treatments without requiring many, complicated, and bulky tools.

SUMMARY OF THE INVENTION

In one form, the invention is directed to a nail treating tool having a graspable handle, a first treating surface, and a second treating surface. The first and second treating surfaces are interchangeably placeable in an operative position relative to the graspable handle such that the graspable handle can be grasped by a user and manipulated to bear one of the first and second treating surfaces that is in the operative position against a nail to effect treatment thereof.

The nail treating tool may have a support to which the first and second treating surfaces are attached. The support is repositionable relative to the graspable handle to selectively interchangeably place the first and second treating surfaces in the operative position.

In one form, the first and second treating surfaces and support are movable as one piece relative to the graspable handle.

In one form, the support is movable relative to the graspable handle around an axis.

In one form, the support has a polygonal shape, as viewed in an axial direction, with a plurality of sides. The first and second treating surfaces are provided on first and second of the sides.

The first and second treating surfaces may have the same or different nail treating properties.

In one form, the support has at least four sides.

In one form, the graspable handle has an elongate base with a length and at least one mounting arm extending in a direction transversely to the length of the elongate base.

The elongate base may be contoured to a plurality of fingers on the hand of a user grasping the graspable handle.

In one form, there are cooperating detent components on the support and graspable handle which releasably maintain the graspable handle and support in a first relative position wherein the first treating surface is in the operative position.

The cooperating detent components may releasably maintain the graspable handle and support in a plurality of different relative positions.

In one form, the first treating surface is separable from the support and replaceable with another treating surface.

In one form, the treating tool includes salt which can be used to treat a user's nail.

The treating tool may further include a supply of salt which is controllably dispensed through the nail treating tool to treat a user's nails with the salt using the nail treating tool.

The invention is further directed to a method of treating nails, which method includes the steps of: providing a tool with a support with a graspable handle and first and second treating surfaces; placing the support and graspable handle in a first relative position wherein the first treating surface is in an operative position; grasping the graspable handle and manipulating the graspable handle to bear the first surface against a nail to effect treatment thereof; placing the support and graspable handle in a second relative position wherein the second treating surface is in an operative position; and grasping the graspable handle and manipulating the graspable handle to bear the second surface against a nail to effect treatment thereof.

The step of placing the support and graspable handle in the second relative position may involve relatively moving the graspable handle and support around an axis with the graspable handle and support initially in the first relative position.

The step of relatively moving the graspable handle and support may involve relatively moving the support and first and second treating surfaces as one piece relative to the graspable handle.

The step of grasping the graspable handle may involve wrapping the user's fingers around an elongate base on the graspable handle so that the elongate base is grasped between the user's fingers and palm.

The method may further include the step of removing the first treatment surface and replacing the first treatment surface with a third treatment surface.

In one form, the step of providing a tool involves providing a tool with a support with a central axis and a polygonal shape as viewed in an axial direction.

The step of providing a tool may involve providing a tool with a support to which a graspable handle is releasably joined.

The step of providing a tool may involve providing a tool with a support with first and second treating surfaces having one of: (a) different fingernail treating properties; and (b) the same fingernail treating properties.

The method may further include the step of using salt to treat a user's nails through the tool.

The method may further include the step of dispensing salt through the tool to against a user's nails to facilitate treatment thereof.

DETAILED DESCRIPTION OF THE DRAWINGS

Figure 1:
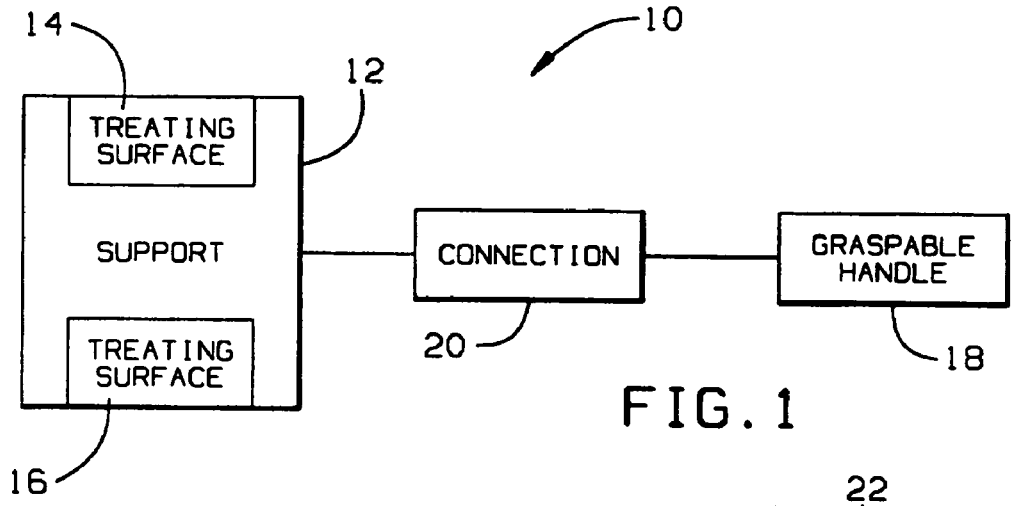
FIG. 1 is a schematic representation of a treating tool for nails, according to the present invention, and consisting of a support with separate treating surfaces thereon and a graspable handle through which the support is manipulated.

A nail treating tool, according to the present invention, is shown in generic form in FIG. 1 at 10. The nail treating tool 10 consists of a support 12 on which separate nail treating surfaces 14,16 are provided. The treating surfaces 14,16 have the same or different nail treating properties.

A graspable handle 18 is joined to the support 12 through a connection 20 in such a manner that the support 12 can be repositioned relative to the graspable handle 18 to selectively place either the treating surface 14 or the treating surface 16 in an operative position. The graspable handle 18 is grasped by a user and manipulated to bear the treating surface 14, 16 that is in the operative position, against a nail to effect treatment thereof.

By interchangeably placing the treating surfaces 14, 16 in the operative position, the user of the treating tool 10 can a) exploit particular treating properties of the surfaces 14, 16, in the event that the properties of the surfaces 14, 16 are different, or b) replace one of the treating surfaces 14, 16 with the other treating surface 14, 16, as in the event the surfaces 14, 16 have the same treating properties and the one of the treating surface 14, 16, initially in the operative position, becomes ineffective for its intended use, for whatever reason, i.e. wear. The user can continuously grasp the handle 18 and move the support 12 to selectively place the desired treating surface 14, 16 in its operative position. Each of the treating surfaces 14, 16 in its operative position is situated relative to the handle 18 in the same manner.

One exemplary form of the nail treating tool is shown in FIGS. 2-6. The support 12 has a central axis 22 and a polygonal perimeter shape, as viewed in an axial direction. In this embodiment, the support 12 has four sides 24,26,28, 30 of equal dimension. The treating surface 14 is on the side 26, with the treating surface 16 on the side 30.

The graspable handle 18 consists of an elongate base 32 that is contoured at 34 to accommodate individual fingers of a user and allow comfortable gripping of the base 32 between the fingers and palm of the user. The graspable handle 18 has spaced legs 36,38 formed as one piece with the base 32 and extending transversely to the length of the base so that the base 32 and legs 36,38 cooperatively define a U shape. The legs 36,38 terminate at mounting portions 40,42, respectively. The mounting portions 40,42 have the same configuration.

Figure 3:
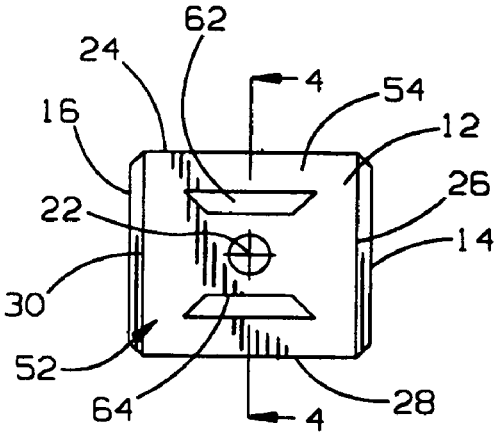
FIG. 3 is an end view of the support on the treating tool in FIG. 2.
Figure 4:
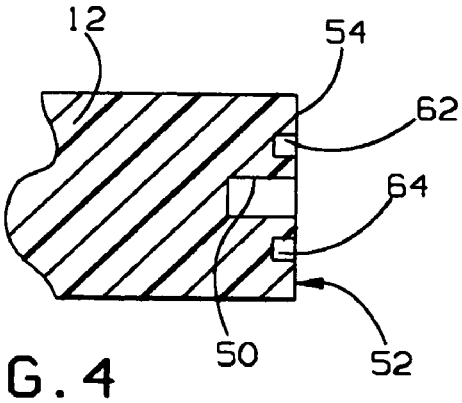
FIG. 4 is a cross-sectional view of the support taken along line 4-4 of FIG. 3.
Figure 5:
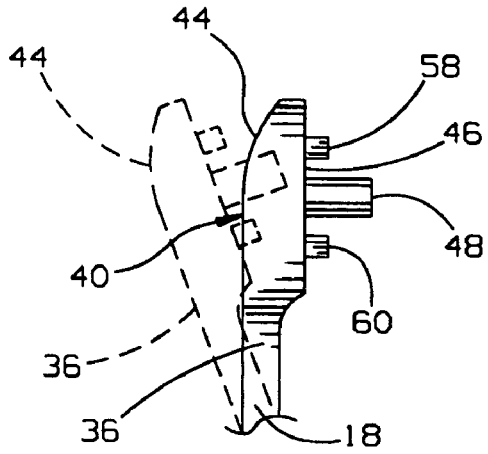
FIG. 5 is a fragmentary, end view of a mounting portion on the graspable handle on the treating tool in FIG. 2.
Figure 6:
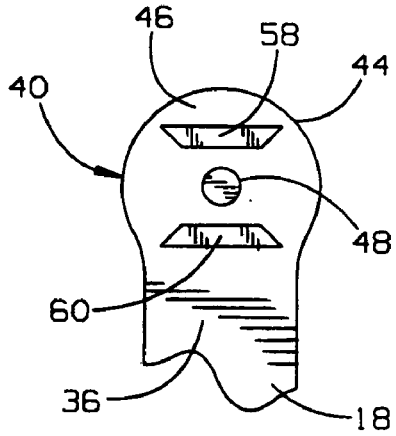
FIG. 6 is a view as in FIG. 5, with the handle pivoted through 90°.

As shown in FIGS. 5 and 6, the exemplary mounting portion 40 consists of an enlargement 44 with a flat surface 46. A stub shaft 48 projects from the surface 46. The stub shaft 48 is designed to be directed into a blind bore 50 in one axial end 52 of the support 12. The support end 52, as seen in FIGS. 3 and 4, has a flat surface 54 that is designed to be placed in close, or facially abutting, relationship with the flat surface 46 on the enlargement 44 on the graspable handle 18.

With the stub shaft 48 directed into the bore 50 at the one axial end 52 of the support 12, and a like stub shaft 48' directed into a blind bore 50' on the opposite axial end 56 of the support 12, the graspable handle 18 and support are guidingly movable relative to each other around the axis 22. The axis 22 resides within the perimeter shape to be spaced from each of the sides making up the perimeter shape.

In this embodiment, the legs 36,38 are made from a material that allows flexing thereof. Accordingly, the legs 36,38 can be bent away from each other, as shown in phantom lines for exemplary leg 36, to allow the stub shafts 48,48' to clear the support ends 52,56 and be directed into alignment with and into their respective bores 50,50'. By then releasing this bending force, the legs 36,38 will tend back towards an undeformed state, thereby "snap fitting" the stub shafts 48,48' into their respective blind bores 50,50'.

The requisite flexing of the graspable handle 18 may be achievable either by having the legs 36,38 bendable, as described above, and/or by making the base 32 bendable. Regardless of the construction, with the snap fit arrangement, it is only necessary that the legs 36,38 be relatively repositionable to change the effective spacing therebetween to allow introduction of the stub shafts 48,48' into the bores 50,50'. This can be achieved by either simultaneously seating the stubs shafts 48,48' or by seating one of the stub shafts 48 and thereafter bending the graspable handle 1 8 to allow introduction of the other stub shaft 48,48' into its associated blind bore 50,50'.

Figure 2:
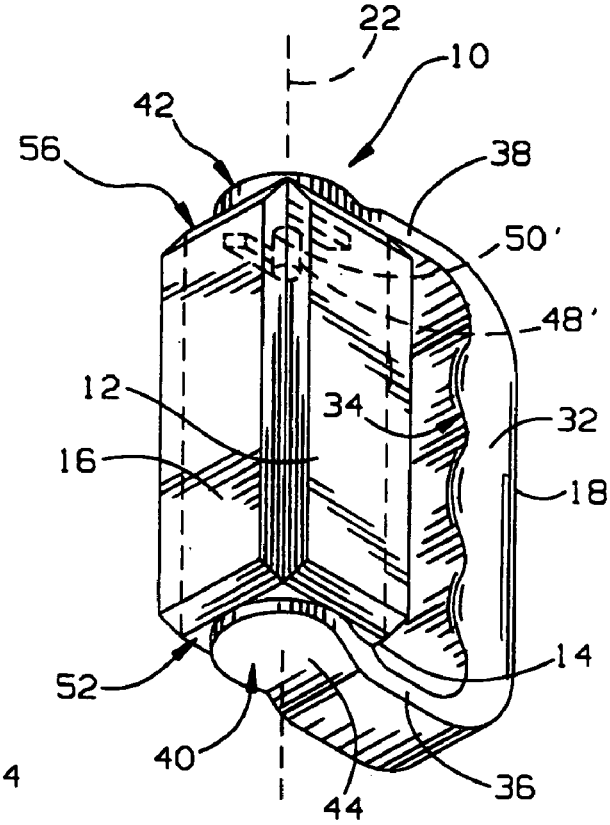
FIG. 2 is a perspective view of one form of nail treating tool, corresponding to that shown generically in FIG. 1.

In FIG. 2, the treating surface 16 is shown in an operative position. In this position, the graspable handle 1 8 is diametrically opposite to the surface 16, whereby a user can conveniently grasp the graspable handle 18 and bear the treating surface 16 against a nail to effect treatment thereof. The relationship between the graspable handle 18 and support 12 may be such that frictional forces between the graspable handle 18 and support 12 are of a magnitude that a substantial torque must be exerted by a user to pivot the support 12 relative to the graspable handle 18 to align the opposite treating surface 14 in the operative position.

More preferably, as shown in FIGS. 3-6, detent components 58,60 are provided on the mounting portion 40 to cooperate with detent components 62,64 at the axial end 52 of the support 12. In this design, the detent components 58,60 project from the flat surface 46 on the mounting portion 40 of the graspable handle 18 and move, one each, into the detent components 62,64, which are each recessed into the flat surface 54 at the axial end 52 of the support 12. The detent components 58,60,62,64 have the same trapezoidal shape, as viewed in an axial direction. With the treating surface 16 in the operative position, the detent component 48 resides within the detent component 62 and the detent component 60 resides within the detent component 64. With the treating surface 14 in the operative position, the detent component 58 resides in the detent component 64 and the detent component 60 resides in the detent component 62.

With the detent components 58,60 residing within the detent components 62,64, a user can grip the graspable handle 18 and exert a torque on the support 12. This produces a camming action between surfaces associated with the detent components 58,60,62,64 which wedges the mounting portions 40,42 axially away from each other sufficiently that the detent components 58,60 move out of the detent components 62,64 to thereby allow the graspable handle 18 and support to be relatively pivoted through 180°, whereupon the detent components 58,60 are received in the detent components 62,64 as an incident of the mounting portions 40,42 tending back towards each other after the camming force produced between the detent components 58,60,62,64 is relieved.

While the structure in FIGS. 2-6 shows one exemplary form of the nail treating tool, this particular construction is not intended to be limiting. The generic showing of the treating tool 10 in FIG. 1 is intended to encompass virtually a limitless number of different forms, of which that shown in FIGS. 2-6 is only exemplary. Some of the other modifications contemplated by the invention will now be described.

Figure 7:
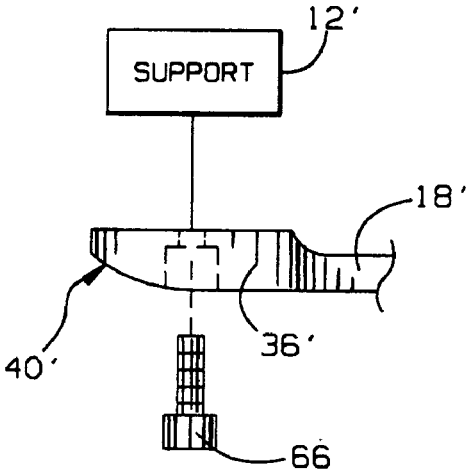
FIG. 7 is a view corresponding to that in FIG. 5 of a modified form of graspable handle, according to the present invention.

As an alternative to providing a graspable handle 18 and support 12 that can be snap fit together, the connection between the graspable handle and support can be accomplished through the use of one or more separate fasteners. As shown in FIG. 7, a modified form of graspable handle 18' has a mounting portion 40' that is connected to a support 12' through a separate fastener 66. This fastening arrangement is shown on one leg 36'. The opposite leg (not shown) can be connected through a structure as shown in either FIG. 2 or FIG. 7. The fastener(s) 66 can be loosened to allow repositioning of the graspable handle 18' and support 12' and thereafter tightened. Alternatively, the fastener(s) can be tightened to a degree that allows the relative positions of the graspable handle 18' and support 12' to be maintained, and changed by exerting a torque on the support that is greater than is exerted during normal use. This potentially obviates the need for detent components.

Figure 8:
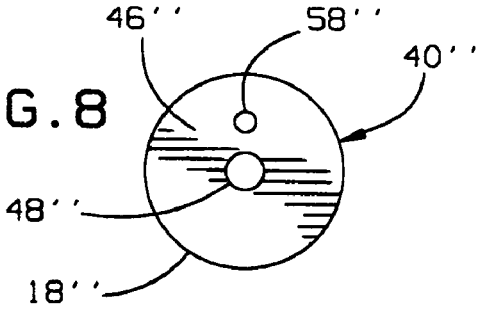
FIG. 8 is a view as in FIG. 6 of a further modified form of graspable handle, according to the present invention.
Figure 9:
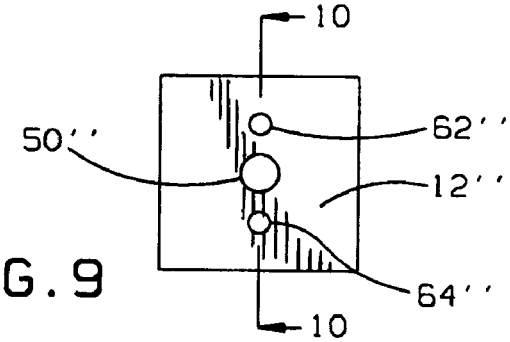
FIG. 9 is a view as in FIG. 3 of a support that cooperates with the graspable handle in FIG. 8.
Figure 10:
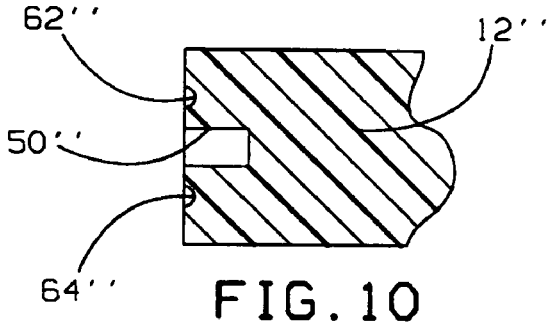
FIG. 10 is a cross-sectional view of the support taken along line 10-10 of FIG. 9.

The trapezoidal configuration for the detent components 58,60,62,64 is again only exemplary in nature. In its most basic construction, as shown in FIGS. 8-10, a detent arrangement may include a single detent component 58" projecting from a surface 46" on a mounting portion 40" of a graspable handle 18". The cooperating support 12" has cooperating detent components 62",64". In this embodiment, the detent component 58" is in the form of a rounded dimple, with the detent components 62",64" each having a complementary shape.

With a stub shaft 48" on the graspable handle 18" in the blind bore 50", the detent component 58"can be moved selectively into the diametrically opposite detent components 62",64" to place the desired treating surface in the operative position. With the detent component 58" in either of the detent components 62",64", a torque generated upon the support 12", while holding the graspable handle 18" stationery, will produce the aforementioned camming action to allow the relative pivoting of the graspable handle 18" and support 12".

It should be noted that there is no limitation intended by the showing of the projecting detent components on the graspable handle. The projecting detent components can be provided on the support in each embodiment disclosed herein.

Figure 11:
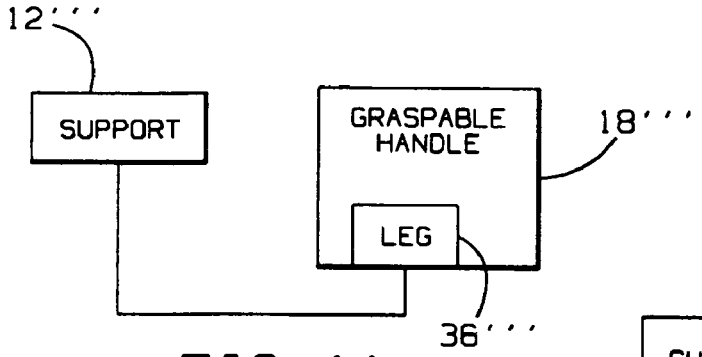
FIG. 11 is a schematic representation of a modified form of graspable handle and cooperating support, according to the present invention.

A further modification is shown in FIG. 11, wherein a graspable handle 18'" is shown with a single leg 36'" for attachment to the support 12'". The means for effecting this attachment are within the knowledge of those skilled in the art.

It is contemplated that the treating surfaces 14, 16 could have any composition known to those in the nail treating art. The surfaces 14,15 could be made from any material to accomplish any different treating operation performed upon nails to alter the surface thereon. As just examples, one or both of the surfaces 14, 16 may be made from an abrasive material, as is common on a nail file. In one form, the abrasive surface is formed as by the embedding of abrasive material in a substrate layer. Files with a wide range of different coarseness are commonly used. Alternatively, the surfaces 14, 16 could be made with a buffing component, such as a cloth, rubber, etc., to produce different levels of shine upon the nail. It is unnecessary to elaborate on all of the different types of treating surfaces 14, 16 contemplated. The invention contemplates the incorporation of any such surface known to those in this art for performing all known treating processes upon nails including forming, abrading, buffing, polishing, etc.

Figure 12:
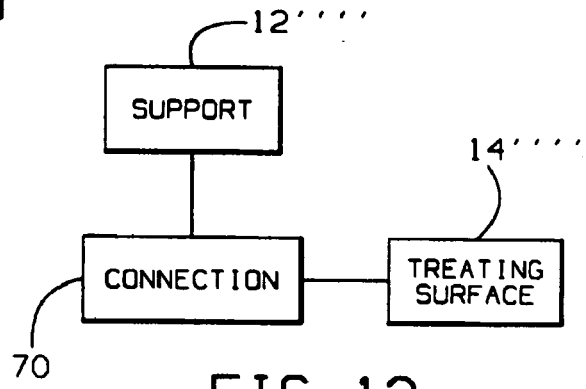
FIG. 12 is a schematic representation of a support and connection between the support and a treating surface thereon, according to the invention.

The invention contemplates that the structure defining the treating surfaces 14, 16 can be either integrally formed with the support 12, or separately attached thereto. As shown in FIG. 12, the treating surface 14"" is shown integrated into the support 12"" through a connection 70. The connection 70 may be permanent or releasable in nature, with the latter allowing interchange of treating surfaces of the same or a different construction at the same location on the support 12"".

Figure 13:
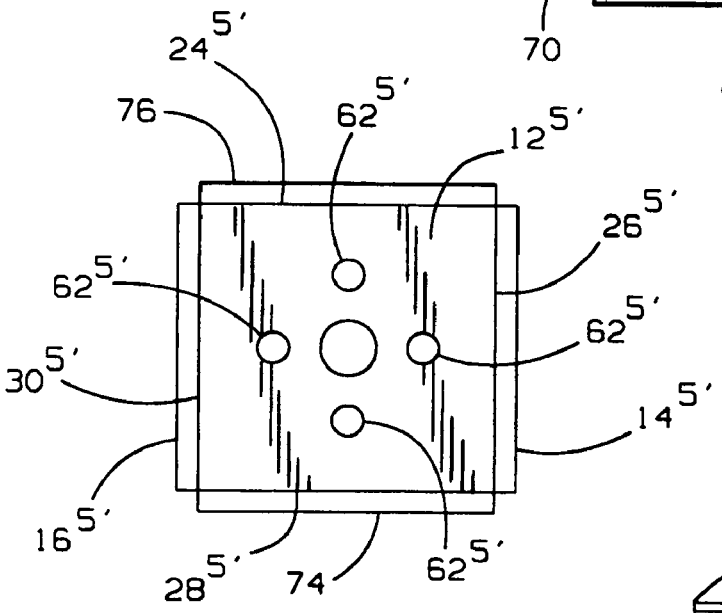
FIG. 13 is an end view of a further modified form of support, according to the present invention.

While two treating surfaces 14, 16 are shown on the treating tool 10 in FIGS. 2-6, as shown in FIG. 13, the treating surfaces can be provided on all exposed surfaces of a support $12^{5x'}$. In this embodiment, the support $12^{5x'}$ has four detent comments $62^{5x'}$ which allow any of four different surfaces $14^{5x'}$, $16^{5x'}$, 74, 76, on the sides $24^{5x'}$, $26^{5x'}$, $28^{5x'}$, $30^{5x'}$ to be consistently placed, and releasably maintained, in an operative position.

Figure 14:
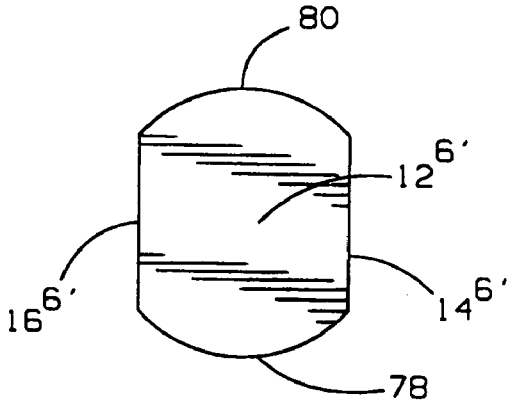
FIG. 14 is a view as in FIG. 13 of a still further modified form of support, according to the present invention.

The shape of the support is not critical to the present invention. For example, it could have a triangular shape or a polygonal shape with the number of sides exceeding the four shown in FIGS. 2-6. Further, it should be understood that the characterization of the shape of the support, as viewed from an axial direction as "polygonal", is intended to encompass not only those configurations where there is a clear polygonal shape, but those wherein there are a plurality of discrete, generally flat, surfaces disposed angularly around an axis. For example, as shown in FIG. 14, a support $\mathbf{12}^{6x'}$ is shown with potentially four different, discrete surfaces $\mathbf{14}^{6x'}$,$\mathbf{16}^{6x'}$, 78, 80. The surfaces 78,80 are convex and facilitate the performance of different nail treatments.

The manner of forming the support is likewise not critical to the present invention. For example, the support may be made as a solid block, as shown in FIG. 2, with integral treating surfaces 14,16. The treating surfaces 15,16 may be separately attached thereto either permanently or removably, as described above. As a further alternative, the support may be defined by a series of joined pieces, such as walls, which produce a hollow construction. In the embodiments shown above, the support and associated treating surfaces move as one piece. However, this is not necessary.

Figure 15:
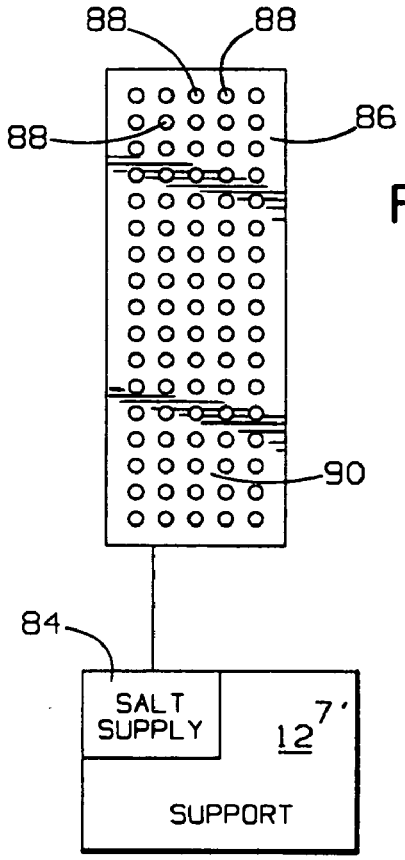
FIG. 15 is a partially schematic representation of a further modified form of support, according to the invention, in/on which a supply of salt is contained to be dispensed for application to a user's nails.

As a further modification, as shown in FIG. 15, a support $\mathbf{12}^{7x'}$ is provided as an associated supply of salt 84. It has been found that salt, and more preferably Dead Sea salt, is healthy for nails. In this embodiment, a wall 86 is provided with an arrangement of openings 88 therethrough and in communication with the salt supply 84. Salt from the supply 84 can be dispersed through the wall to against the user's nail to facilitate treatment thereof. The wall 86 may have a surface 90 for treating a user's nails with the applied salt.

Figure 16:
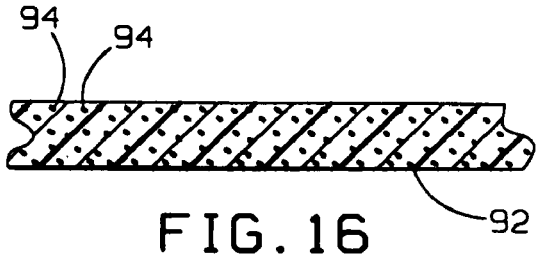
FIG. 16 is a fragmentary, cross-sectional view of a layer defining a treating surface, according to the invention, with salt embedded therein.
Figure 17:
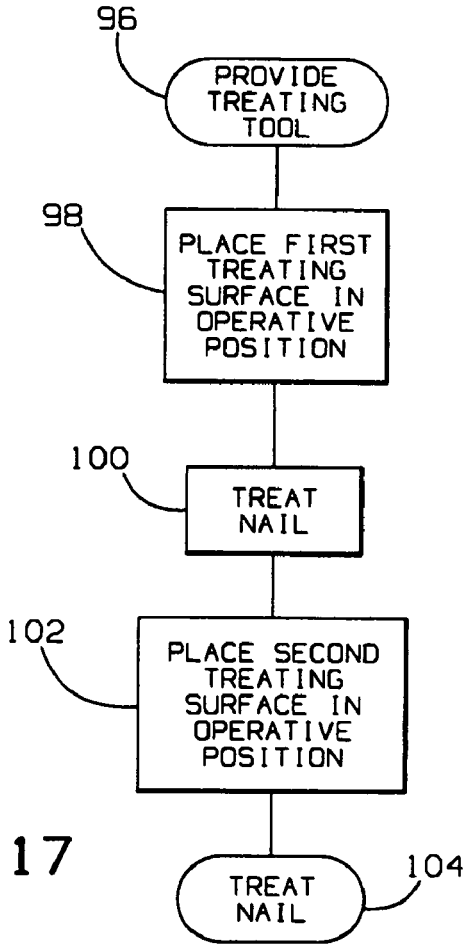
FIG. 17 is a flow diagram representation of a method of treating nails, according to the present invention.

As a further variation, as shown in FIG. 16, a tool may be provided with a wall 92 having salt particles 94, fixed, or embedded thereon, for treatment of a user's nails. The wall 92 may be part of a tool, such as a part of a support thereon.

With the structure described above, the following method of treating nails can be carried out. As shown at block 96, a treating tool is provided having a support with a graspable handle and first and second treating surfaces. As shown at block 98, the first treating surface on the treating tool is placed in an operative position. As shown at block 100, the graspable handle is gripped and manipulated to bear the first treating surface against a nail, to effect treatment thereof. Thereafter, as shown block 102, the second treating surface is placed in the operative position. Finally, as shown at block 104, the nail is treated with the second surface through manipulation of the graspable handle.

While the invention has been described with particular reference to the drawings, it should be understood that various modifications could be made without departing from the spirit and scope of the present invention.

The invention claimed is:

1. A nail treating tool comprising:

a graspable handle;

a support;

a first treating surface for altering an exposed surface of a user's nail; and a second treating surface, the first and second treating surfaces both attached to the support and interchangeably placeable in an operative position relative to the graspable handle such that the graspable handle can be grasped in a first manner for use by a user and manipulated to bear one of the first and second treating surfaces that is in the operative position against a user's nail to effect treatment thereof, wherein the support is movable guidingly relative to the graspable handle to thereby selectively place the first and second treating surfaces in the operative position without separating the graspable handle and support from each other, the graspable handle graspable for use by a user with a user's fingers wrapping around the handle so as to reside between the handle and the support with each of the first and second treating surfaces in the operative position, wherein the first and second treating surfaces and support are movable as one piece relative to the graspable handle, wherein the support is movable guidingly relative to the graspable handle around an axis, wherein the graspable handle has an elongate base with a length and the length of the elongate base is substantially parallel to the axis and the elongate base is spaced from the support with each of the first and second treating surfaces in the operative position to allow extension of a user's fingers between the elongate base and the support in a manner whereby: a) the user's fingers extended between the elongate base and support can be wrapped around the elongate base to hold the nail treating tool; and b) the user's fingers extended between the elongate base and support can be pressed against the support to bear each of the first and second treating surfaces, when in the operative position, against a surface to be selectively treated by the first and second treating surfaces, the support having a perimeter shape defined by a plurality of sides including at least the first and second sides as viewed in an axial direction, the axis residing within the perimeter shape and spaced from each of the plurality of sides, wherein the first and second surfaces are moveable as one piece with the support around the axis, wherein the handle comprises a portion that can be grasped and continuously held by a user as the user moves the support around the axis to thereby place the first and second treating surfaces each selectively in the operative position, wherein the first treating surface when in the operative position is situated relative to the handle in a first manner and the second treating surface when in the operative position is situated relative to the handle in a manner substantially the same as the first manner.

2. The nail treating tool according to claim 1 wherein the support has a substantially square shape as viewed in an axial direction with a plurality of sides, the first and second treating surfaces are provided on first and second of the sides and a space is defined between the elongate base and the first treating surface with the second treating surface in the operative position into which a user's fingers extend while grasping the elongate base.

3. The nail treating tool according to claim 1 wherein the first and second treating surfaces have different nail treating properties.

4. The nail treating tool according to claim 1 wherein the support has at least three sides each upon which different nail treating surfaces are provided and can each be placed in an operative position wherein the treating surface on the at least three sides are situated relative to the handle in substantially the first manner.

5. The nail treating tool according to claim 1 wherein the elongate base, at a region bounding a space between the elongate base and the support, is contoured to a plurality of fingers on the hand of a user with the user's fingers extended between the elongate base and the support.

6. The nail treating tool according to claim 1 wherein there are cooperating detent components on the support and graspable handle which releasably maintain the graspable handle and support in a first relative position wherein the first treating surface is in the operative position.

7. The nail treating tool according to claim 6 wherein the cooperating detent components releasably maintain the graspable handle and support in a plurality of different relative positions.

8. The nail treating tool according to claim 1 wherein the first treating surface is separable from the support and replaceable with another treating surface.

9. The nail treating tool according to claim 1 wherein the treating tool comprises a supply of salt which is retained by the nail treating tool and can be used to treat a user's nails.

10. The nail treating tool according to claim 1 further comprising a supply of salt in the support, which salt is controllably dispensed through the nail treating tool to treat a user's nail with the salt using the nail treating tool.

11. The nail treating tool according to claim 1 wherein the first treating surface is removable and further in combination with a third treating surface that can be used to replace the first treating surface.

12. The nail treating tool according to claim 1 wherein the graspable handle is releasably joined to the support.

13. The nail treating tool according to claim 1 wherein the graspable handle and support are selectively snap fittable together and separable from each other without requiring the use of tools or separate fasteners, wherein the graspable handle is U-shaped with spaced legs on an elongate base and between which the support resides, and wherein at least one of the spaced legs is bendable away from the other of the spaced legs to allow the support to be placed between and separated from between the legs.

14. The nail treating tool according to claim 13 wherein there is a shaft that cooperates between the support and graspable handle and guides the support and graspable handle in relative movement around an axis.

15. The nail treating tool according to claim 1 wherein the entire nail treating tool is dimensioned to be held as a unit in a user's hand.

* * * * *